US012735241B2

(12) United States Patent
Yuan et al.

(10) Patent No.: US 12,735,241 B2
(45) Date of Patent: Sep. 15, 2026

(54) HEAT PRESERVATION APPLIANCE

(71) Applicant: Jiangmen Nanguang Electrical Appliance Industrial Co., Ltd., Jiangmen City (CN)

(72) Inventors: Rongen Yuan, Jiangmen City (CN); Qinzhang Ou, Jiangmen City (CN)

(73) Assignee: JIANGMEN NANGUANG ELECTRICAL APPLIANCE INDUSTRIAL CO., LTD., Jiangmen City (CN)

( * ) Notice: Subject to any disclaimer, the term of this patent is extended or adjusted under 35 U.S.C. 154(b) by 0 days.

(21) Appl. No.: 18/812,399

(22) Filed: Aug. 22, 2024

(65) Prior Publication Data

US 2025/0382119 A1 Dec. 18, 2025

(30) Foreign Application Priority Data

Jun. 12, 2024 (CN) ..... 202421337824.3

(51) Int. Cl.
*B65D 81/20* (2006.01)

(52) U.S. Cl.
CPC ..... *B65D 81/2038* (2013.01); *B65D 2581/34* (2013.01)

(58) Field of Classification Search
CPC ... B65D 81/2038; B65D 2581/34; A47J 47/10
USPC ..... 220/212, 231, 240; 215/228, 262, 270; 141/65; 417/545; 206/524.8; 99/454, 99/472
See application file for complete search history.

(56) References Cited

U.S. PATENT DOCUMENTS 1,635,815 A * 7/1927 Briggs ..... A23B 2/708 220/325
1,672,904 A * 6/1928 Randall ..... B65D 81/3818 220/592.27
2,036,007 A * 3/1936 Wheatley ..... A23B 2/103 99/472

(Continued)

FOREIGN PATENT DOCUMENTS

AU 2018100135 A4 3/2018
CN 2616493 Y * 5/2004

(Continued)

OTHER PUBLICATIONS

European Patent Office, "Search Report" in Application No. 24206081.2-1015, Mar. 4, 2025, 11 pages.

*Primary Examiner* — Orlando E Aviles
*Assistant Examiner* — Brijesh V. Patel
(74) *Attorney, Agent, or Firm* — Davis Wright Tremaine LLP

(57) ABSTRACT

The disclosure discloses a heat preservation appliance, including: a box body provided with a first inner container; a cover body including an inner cover and an outer cover, wherein the inner cover covers the first inner container, the inner cover is provided with a check valve, the outer cover is connected to the box body, the outer cover is provided with an avoidance hole, and the avoidance hole is arranged corresponding to the check valve; and an evacuating device connected to the check valve through the avoidance hole, wherein the evacuating device extracts air in the first inner container through the check valve.

11 Claims, 8 Drawing Sheets

(56) References Cited

U.S. PATENT DOCUMENTS 2,173,571 A * 9/1939 Jesnig ..... B65D 51/1644 222/569
3,823,567 A * 7/1974 Corini ..... F25B 21/02 62/3.62
4,051,971 A * 10/1977 Saleri ..... B65D 81/2038 99/476
4,149,650 A * 4/1979 Whelchel ..... A61L 2/26 206/509
4,763,802 A * 8/1988 Johnston ..... B67D 1/10 53/88
4,823,968 A * 4/1989 Handzlik ..... B65B 31/047 215/260
5,390,809 A * 2/1995 Lin ..... F16K 15/1825 220/592.27
5,398,811 A * 3/1995 Latella, Jr. ..... A47J 47/04 206/524.8
5,558,243 A * 9/1996 Chu ..... B65D 81/2038 220/240
5,597,086 A * 1/1997 King-Shui ..... A47J 41/02 220/592.16
5,651,470 A * 7/1997 Wu ..... F16J 13/24 220/240
5,692,632 A * 12/1997 Hsieh ..... B65D 81/20 220/240
5,806,575 A * 9/1998 Tsay ..... B65D 81/2015 141/192
5,957,317 A * 9/1999 Lee ..... B65D 81/2038 220/240
6,264,054 B1 * 7/2001 Miyake ..... B65D 81/2038 220/23.91
6,510,946 B2 * 1/2003 Gutierrez ..... A45C 11/20 206/524.8
6,830,081 B1 * 12/2004 Chen ..... F04B 35/04 220/203.19
7,246,555 B2 * 7/2007 Small ..... A47J 47/10 215/262
7,931,052 B2 * 4/2011 Schooley ..... B65D 81/2015 141/8
8,807,370 B2 * 8/2014 Lee ..... B65D 45/327 220/378
8,967,413 B2 * 3/2015 Tinstman ..... B65B 31/04 220/203.11
9,296,543 B2 * 3/2016 Wooldridge ..... B65D 81/3813
9,668,510 B2 * 6/2017 Doman ..... A23B 2/103
10,722,427 B2 * 7/2020 Cantor ..... A61J 1/165
11,021,311 B2 * 6/2021 Pace ..... A47J 41/02
11,370,592 B2 * 6/2022 Wang ..... B65D 51/1644
11,390,449 B2 * 7/2022 Wooldridge ..... B65B 31/00
2005/0051551 A1 * 3/2005 Galletti ..... B65D 81/2038 220/212
2007/0000396 A1 * 1/2007 Kieck ..... A47J 47/12 99/476
2008/0078466 A1 * 4/2008 Wang ..... B65D 81/2038 141/65
2010/0084307 A1 * 4/2010 Yeghiayan ..... A22C 9/005 206/524.8
2010/0200599 A1 * 8/2010 Molthen ..... B65D 19/06 220/592.27
2010/0237078 A1 * 9/2010 Lentz ..... A47G 19/2288 220/378
2013/0146500 A1 * 6/2013 Kim ..... B65D 81/2038 206/524.8
2016/0376083 A1 * 12/2016 Sun ..... B65D 81/2015 141/65
2017/0210523 A1 * 7/2017 Pisarevsky ..... A47G 19/2272
2018/0009589 A1 * 1/2018 Ho ..... B65D 53/02
2019/0084749 A1 * 3/2019 Lapidot ..... B65D 51/1688
2019/0210786 A1 * 7/2019 Hsu ..... B65D 81/02
2019/0248563 A1 * 8/2019 Ho ..... B65D 45/02
2020/0223603 A1 * 7/2020 Ames ..... A47J 47/02

FOREIGN PATENT DOCUMENTS

CN 212048780 U 12/2020
CN 218355900 U 1/2023
CN 221069253 U 6/2024
KR 101833259 B1 * 3/2018 ..... B65D 61/2038
KR 102288691 B1 8/2021

* cited by examiner

HEAT PRESERVATION APPLIANCE

CROSS-REFERENCE TO RELATED APPLICATIONS

The present disclosure claims priority to and the benefit of Chinese Patent Application No. 202421337824.3 filed Jun. 12, 2024, the contents of which are incorporated herein by reference.

TECHNICAL FIELD

The present disclosure relates to the technical field of food storage appliances, and in particular to a heat preservation appliance.

BACKGROUND

Heat preservation appliances at present are mainly used for food heat preservation or reheating food, in which the temperature of the food can be guaranteed, but the fresh-keeping time of the food is short, and thus the food is easy to deteriorate.

SUMMARY

The present disclosure aims to solve at least one of the technical problems in the existing technology. Therefore, the present disclosure provides a heat preservation appliance, which can not only achieve heat preservation of the food, but also prolong a fresh-keeping time of the food.

According to a first aspect of the present disclosure, an embodiment provides a heat preservation appliance, including: a box body provided with a first inner container; a cover body including an inner cover and an outer cover, wherein the inner cover covers the first inner container, the inner cover is provided with a check valve, the outer cover is connected to the box body, the outer cover is provided with an avoidance hole, and the avoidance hole is arranged corresponding to the check valve; and an evacuating device connected to the check valve through the avoidance hole, wherein the evacuating device extracts air in the first inner container through the check valve.

The heat preservation appliance according to the embodiment of the present disclosure at least has the following beneficial effects: after the cover body is covered on the first inner container and the evacuating device is connected to the check valve through the avoidance hole, and the air in the first inner container is extracted by the evacuating device to keep the first inner container in a low pressure or vacuum state, so that breeding of bacteria in the air is avoided, the fresh-keeping time of the food in the first inner container is prolonged, and the food is both fresh-keeping and heat-preserving.

According to some embodiments of the present disclosure, the check valve includes a valve body, the inner cover is provided with an air hole matched with the valve body, an air passage is formed by the matching cooperation between the valve body and the air hole, and two ends of the valve body are protruded in a radial direction to form a first sealing part.

According to some embodiments of the present disclosure, an end face at a side of the air hole facing the first inner container protrudes to form a first abutting part, the first abutting part abuts against the first sealing part, the first abutting part is provided with a ventilation groove in the radial direction, and the ventilation groove is communicated with the air hole.

According to some embodiments of the present disclosure, an end face at a side of the air hole facing the outer cover protrudes to form a second abutting part, and the second abutting part abuts against the first sealing part.

According to some embodiments of the present disclosure, the valve body is provided with a first chamber and a second chamber, the first chamber is arranged at an upper end of the valve body, the first chamber is communicated with outside environment, the second chamber is arranged at a lower end of the valve body, and the second chamber is communicated with the first inner container.

According to some embodiments of the present disclosure, the box body is provided with a second inner container, the first inner container is arranged on the second inner container, and both a bottom wall and a side wall of the first inner container abut against the second inner container.

According to some embodiments of the present disclosure, an edge of the first inner container protrudes to form a bearing part, the inner cover is provided with a sealing ring, the sealing ring protrudes to form a second sealing part, and the inner cover drives the second sealing part to abut against the bearing part.

According to some embodiments of the present disclosure, a side of the inner cover facing the first inner container protrudes to form a guide part, the sealing ring is arranged between the guide part and a side wall of the first inner container, and the sealing ring respectively abuts against the guide part and the side wall of the first inner container.

According to some embodiments of the present disclosure, the sealing ring protrudes to form a third sealing part, and the third sealing part abuts against the side wall of the first inner container.

According to some embodiments of the present disclosure, an outer side of the box body is provided with an accommodating groove, the accommodating groove is matched with the evacuating device, and the accommodating groove is used for accommodating the evacuating device.

The additional aspects and advantages of the present disclosure will be given in part in the following description, and will become apparent in part from the following description, or will be learned through the practice of the present disclosure.

BRIEF DESCRIPTION OF THE DRAWINGS

The above and/or additional aspects and advantages of the present disclosure will be more apparent from the following description of the embodiments in conjunction with the accompanying drawings, wherein.

REFERENCE NUMERALS

Figure 1:
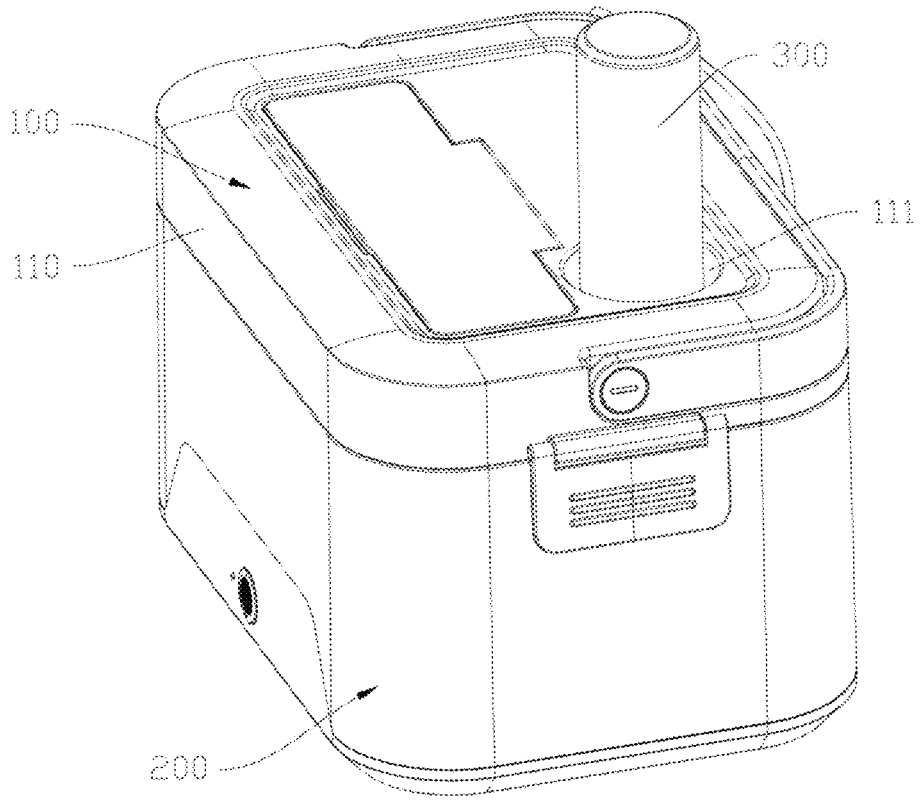
FIG. 1 is a schematic diagram of a heat preservation appliance according to a first embodiment of the present disclosure.

100—cover body; 110—outer cover; 111—avoidance hole; 120—inner cover; 121—air hole; 122—ventilation groove; 123—first abutting part; 124—second abutting part; 125—guide part; 126—splicing groove; 130—valve body; 131—first sealing part; 132—first chamber; and 133—second chamber; 200—box body; 201—accommodating groove; 210—first inner container; 211—bearing part; 220—second inner container; 230—sealing ring; 231—second sealing part; 232—third sealing part; and 233—splicing part; and 300—evacuating device.

DETAILED DESCRIPTION

The embodiments of the present disclosure will be described in detail hereinafter. Examples of the embodiments are shown in the drawings. The same or similar reference numerals throughout the drawings denote the same or similar elements or elements having the same or similar functions. The embodiments described below by reference to the accompanying drawings are exemplary and are intended only to explain the present disclosure and are not to be construed as limiting the present disclosure.

In the description of the present disclosure, it should be understood that the orientation or positional relationship indicated by the terms upper, lower, front, back, left and right is based on the orientation or positional relationship shown in the drawings, only for the convenience of describing the present disclosure and simplifying the description, and does and not indicate or imply that the indicated device or element must have a specific orientation, or be constructed and operated in a specific orientation. Therefore, the terms should not be construed as limiting the present disclosure.

In the description of the present disclosure, the meaning of several refers to be one or more, and the meaning of multiple refers to be more than two. The meanings of greater than, less than, more than, etc., are understood as not including this number, while the meanings of above, below, within, etc., are understood as including this number. If first and second are described, the descriptions are used for the purpose of distinguishing the technical features only, and cannot be understood as indicating or implying relative importance, or implicitly indicating the number of technical features indicated thereby, or implicitly indicating the order of technical features indicated thereby.

In the description of the present disclosure, unless otherwise explicitly defined, words such as setting, mounting and connecting should be understood a broad sense, and those skilled in the art can reasonably determine the specific meanings of the above words in the present disclosure in combination with the specific contents of the technical solutions.

Referring to FIG. 1 to FIG. 4, a heat preservation appliance according to a first aspect of the present disclosure includes: a box body 200 provided with a first inner container 210; a cover body 100 including an inner cover 120 and an outer cover 110, wherein the inner cover 120 covers the first inner container 210, the inner cover 120 is provided with a check valve, the outer cover 110 is connected to the box body 200, the outer cover 110 is provided with an avoidance hole 111 arranged corresponding to the check valve; and an evacuating device 300 connected to the check valve through the avoidance hole 111, wherein the evacuating device 300 extracts air in the first inner container 210 through the check valve.

After the cover body 100 is covered on the first inner container 210 and the evacuating device 300 is connected to the check valve through the avoidance hole 111, the air in the first inner container 210 is extracted by the evacuating device 300 to keep the first inner container 210 in a low pressure or vacuum state, so that breeding of bacteria in the air can be avoided, a fresh-keeping time of food in the first inner container 210 is prolonged, and the food is both in fresh-keeping and heat-preserving.

Figure 3:
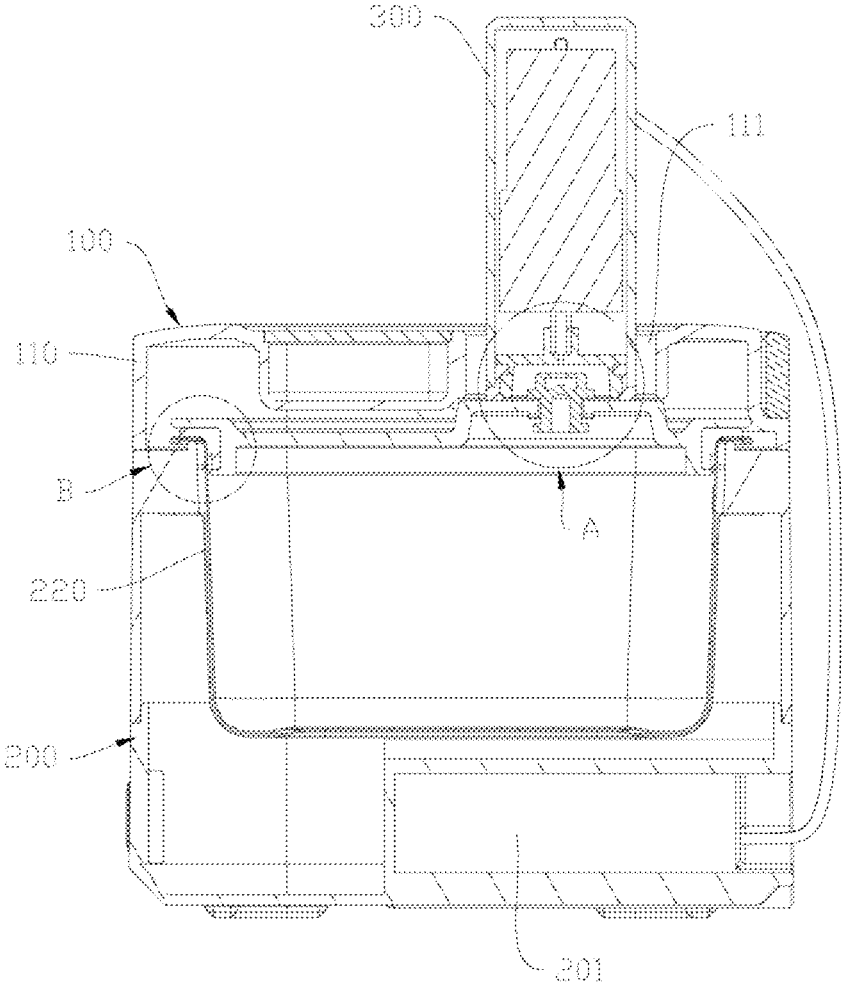
FIG. 3 is a sectional view of the heat preservation appliance according to the first embodiment of the present disclosure.
Figure 4:
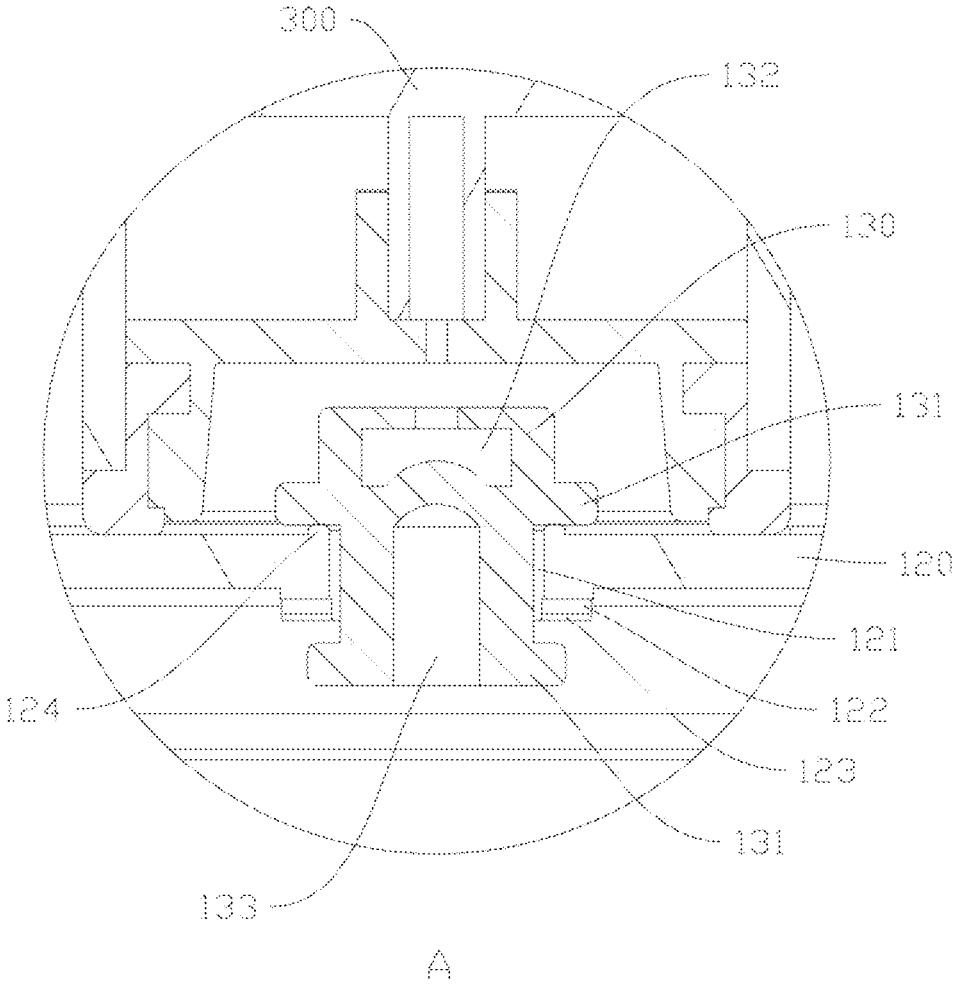
FIG. 4 is a partially enlarged schematic diagram of a portion A in FIG. 3.

It can be understood that, referring to FIG. 3 and FIG. 4, the check valve includes a valve body 130, the inner cover 120 is provided with an air hole 121 matched with the valve body 130, an air passage is formed by the matching cooperation between the valve body 130 and the air hole 121, and two ends of the valve body 130 are protruded in a radial direction to form a first sealing part 131. When the evacuating device 300 evacuates the air, a pressure at an upper end of the valve body 130 is reduced, and a pressure in the first inner container 210 is greater than an external pressure, which drives the valve body 130 to move upward and opens the air passage. The air in the first inner container 210 is evacuated away along the air passage, so that the pressure in the first inner container 210 is continuously reduced until a vacuum state is reached. Then, the evacuating device 300 is removed, and the valve body 130 is pressed against the inner cover 120 under the action of the external pressure, so that the check valve is closed, and the inside of the first inner container 210 is kept in a vacuum state, and the fresh-keeping time of the food is prolonged. The valve body 130 is made of silica gel. When the cover body 100 is opened, the valve body 130 is deformed by pressing, and air flows into the first inner container 210 from a gap between the valve body 130 and the inner cover 120 to raise the pressure in the first inner container 210, so that the cover body 100 can be opened and difficulty of opening the cover body 100 can be reduced.

It can be understood that, referring to FIG. 4, an end face at a side of the air hole 121 facing the first inner container 210 protrudes to form a first abutting part 123, the first abutting part 123 abuts against the first sealing part 131, and the first abutting part 123 is provided with a ventilation groove 122 in the radial direction, and the ventilation groove 122 is communicated with the air hole 121. When evacuating, the valve body 130 moves upward, and the first sealing part 131 at a lower end of the valve body 130 abuts against the first abutting part 123. The air flows into the air hole 121 from the ventilation slot 122 and flows out along the air passage. When the inside of the first inner container 210 reaches vacuum and there is no pressure difference between the inside and outside of the first inner container 210, the valve body 130 descends, and the first sealing part 131 at an upper end of the valve body 130 abuts against an upper end face of the air hole 121. After the evacuating device 300 is separated from the cover body 100, the first sealing part 131 is tightly attached to the upper end face of the air hole 121 under the action of the pressure, so as to close the air hole 121 and prevent the air hole 121 from leaking.

It can be understood that, referring to FIG. 4, an end face at a side of the air hole 121 facing the outer cover 110 protrudes to form a second abutting part 124, and the second abutting part 124 abuts against the first sealing part 131. The first sealing part 131 is deformed when abutting against the second abutting part 124, thereby improving a sealing performance between the first sealing part 131 and the upper end face of the air hole 121.

It can be understood that, referring to FIG. 4, the valve body 130 is provided with a first chamber 132 and a second chamber 133. The first chamber 132 is arranged at an upper end of the valve body 130, and the first chamber 132 is communicated with outside environment. The second chamber 133 is arranged at a lower end of the valve body 130, and the second chamber 133 is communicated with the first inner container 210. By setting the first chamber 132, it is convenient for the pressure to act on the valve body 130 uniformly, and a sealing effect of the first sealing part 131 is improved. Similarly, through the communication between the second chamber 133 and the inside of the first inner container 210, the pressure acts on the valve body 130 uniformly, resulting in that the evacuating device 300 can evacuate air smoothly.

It can be understood that, referring to FIG. 3, the box body 200 is provided with a second inner container 220, the first inner container 210 is arranged on the second inner container 220, and both a bottom wall and a side wall of the first inner container 210 abut against the second inner container 220. The second inner container 220 is provided with a heating element, and the second inner container 220 is in contact with the bottom wall and the side wall of the first inner container 210 to heat the first inner container 210, and the first inner container 210 is heated uniformly, so that it is convenient to heat the food in a vacuum state, and the growth of bacteria can be avoided. Therefore, after the food being heated, the influence of the bacteria on the food is reduced when opening the cover body 100 and eating the food.

Figure 5:
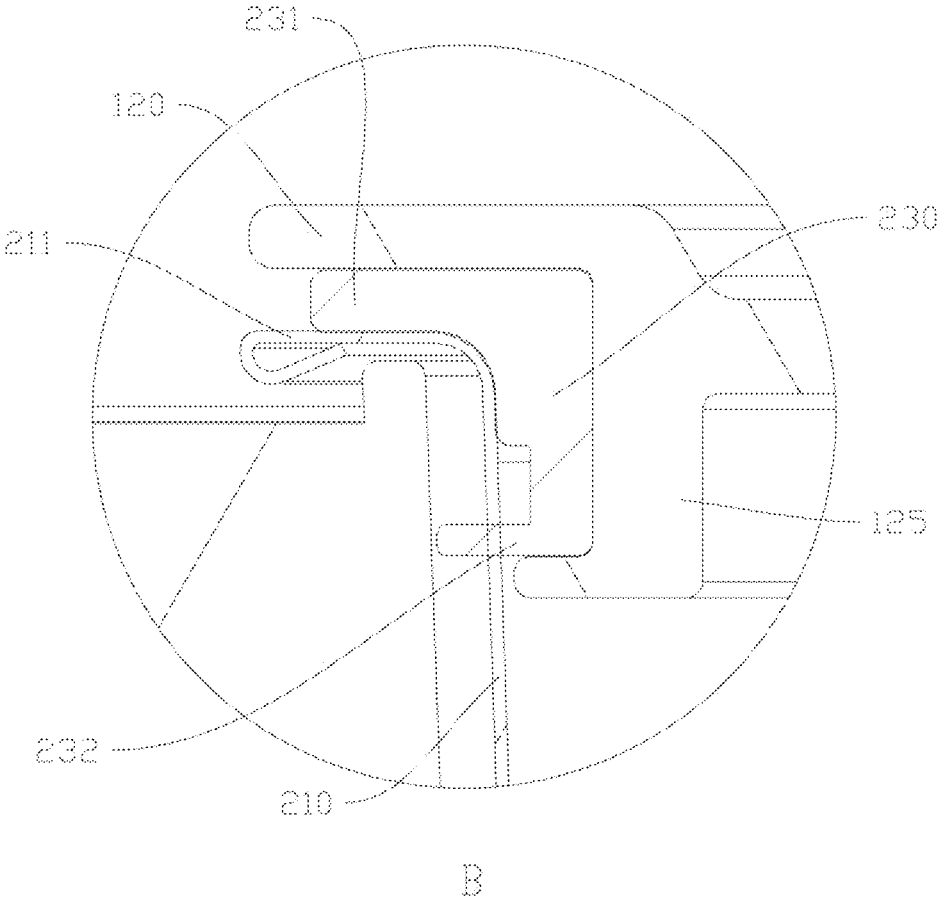
FIG. 5 is a partially enlarged schematic diagram of a portion B in FIG. 3.

It can be understood that, referring to FIG. 3 and FIG. 5, an edge of the first inner container 210 protrudes to form a bearing part 211, the inner cover 120 is provided with a sealing ring 230, the sealing ring 230 protrudes to form a second sealing part 231, and the inner cover 120 drives the second sealing part 231 to abut against the bearing part 211. When the cover body 100 is connected to the box body 200, the inner cover 120 presses the second sealing part 231 against the bearing part 211, and the sealing performance between the inner cover 120 and the first inner container 210 is improved through the deformation of the second sealing part 231.

Figure 7:
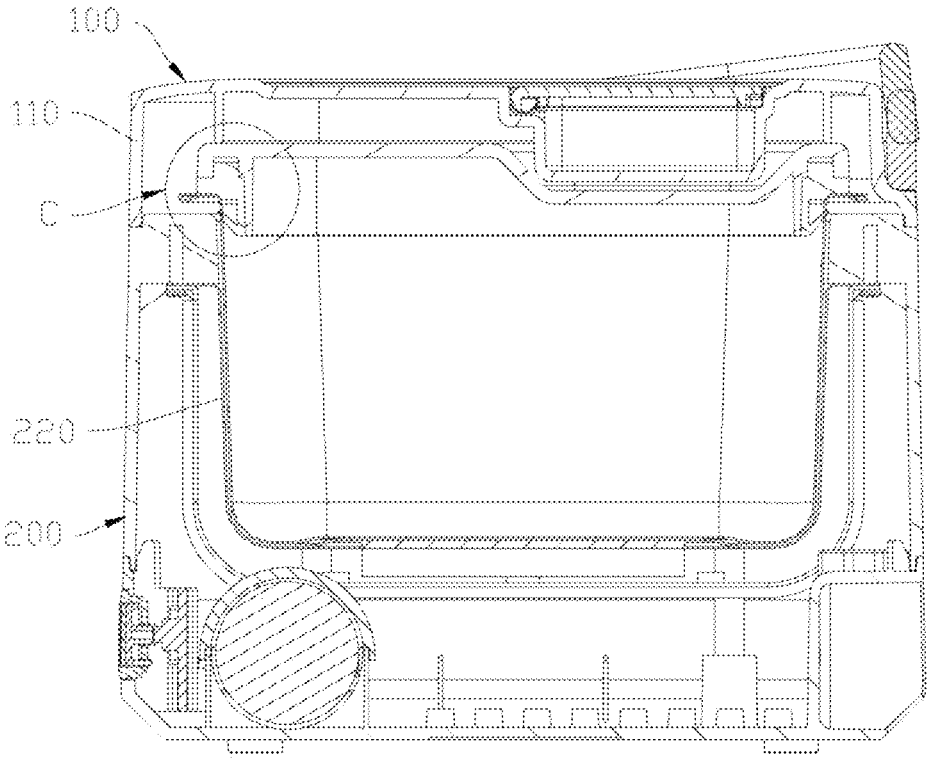
FIG. 7 is a sectional view of the heat preservation appliance according to the second embodiment of the present disclosure.
Figure 8:
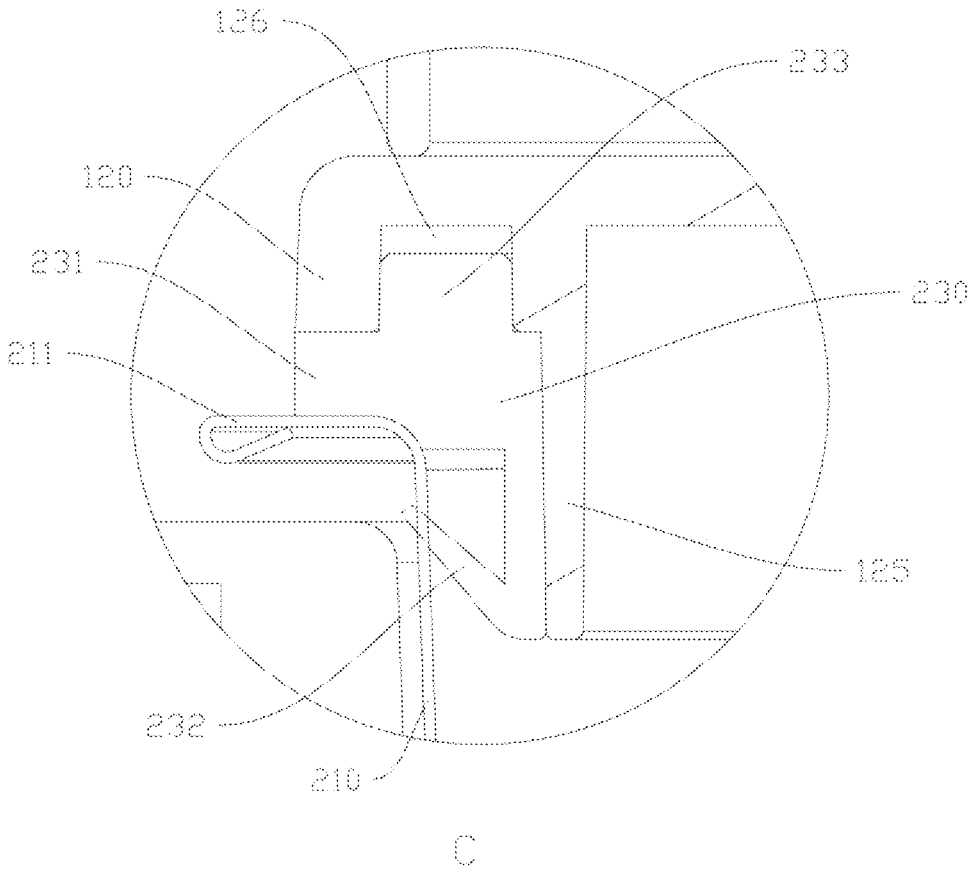
FIG. 8 is a partially enlarged schematic diagram of a portion C in FIG. 7.

Referring to FIG. 7 and FIG. 8, the second embodiment of the sealing ring 230 is illustrated. The sealing ring 230 is provided with a splicing part 233, and the inner cover 120 is provided with a splicing groove 126 matched with the splicing part 233. The splicing part 233 is closely attached to a side wall of the splicing groove 126 through the splicing and matching of the splicing part 233 with the splicing groove 126, and the sealing ring 230 is stably assembled on the inner cover 120 by using a friction force between the splicing part 233 and the splicing groove 126.

It can be understood that, referring to FIG. 3 and FIG. 5, a side of the inner cover 120 facing the first inner container 210 protrudes to form a guide part 125, the sealing ring 230 is arranged between the guide part 125 and a side wall of the first inner container 210, and the sealing ring 230 respectively abuts against the guide part 125 and the side wall of the first inner container 210. Through the guide part 125, the cover body 100 can be conveniently and quickly covered on the first inner container 210, and the sealing ring 230 is arranged between the side wall of the first inner container 210 and the guide part 125, so that the sealing between the guide part 125 and the first inner container 210 is realized, and the sealing performance is improved.

It can be understood that, referring to FIG. 3 and FIG. 5, the sealing ring 230 protrudes to form a third sealing part 232, and the third sealing part 232 abuts against the side wall of the first inner container 210. When the cover body 100 is covered on the first inner container 210, the third sealing part 232 is in contact with the side wall of the first inner container 210 and deforms, so that the third sealing part 232 is close to the side wall of the first inner container 210, further improving the sealing performance of the sealing ring 230.

Figure 2:
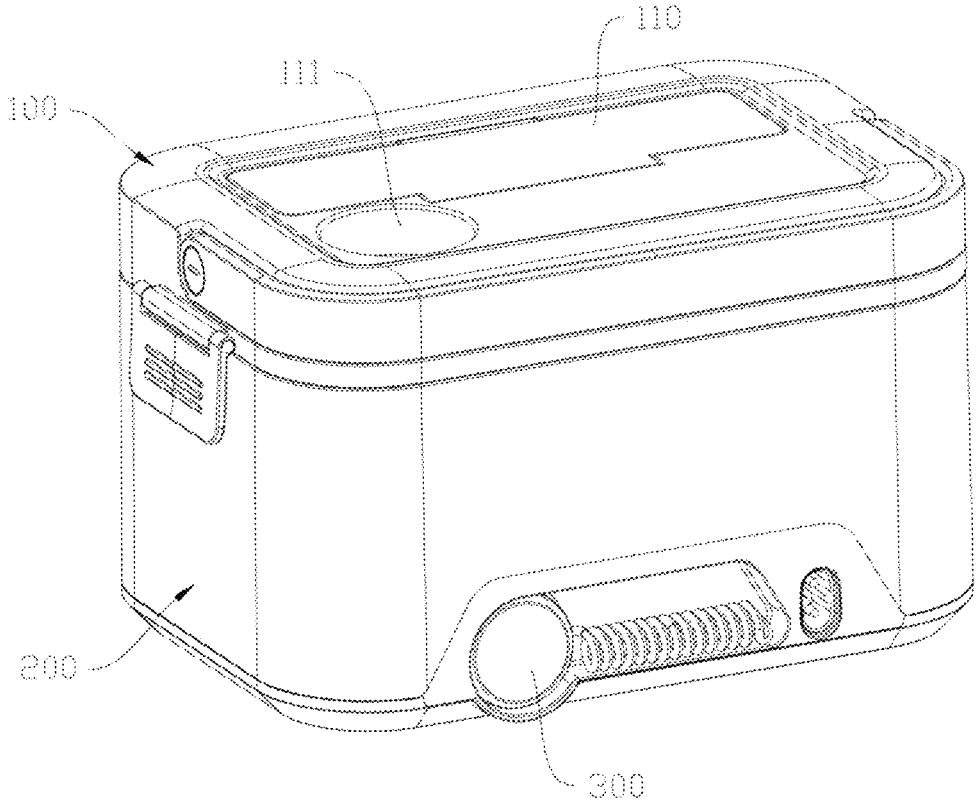
FIG. 2 is a schematic diagram of accommodating of an evacuating device of the heat preservation appliance according to the first embodiment of the present disclosure.
Figure 6:
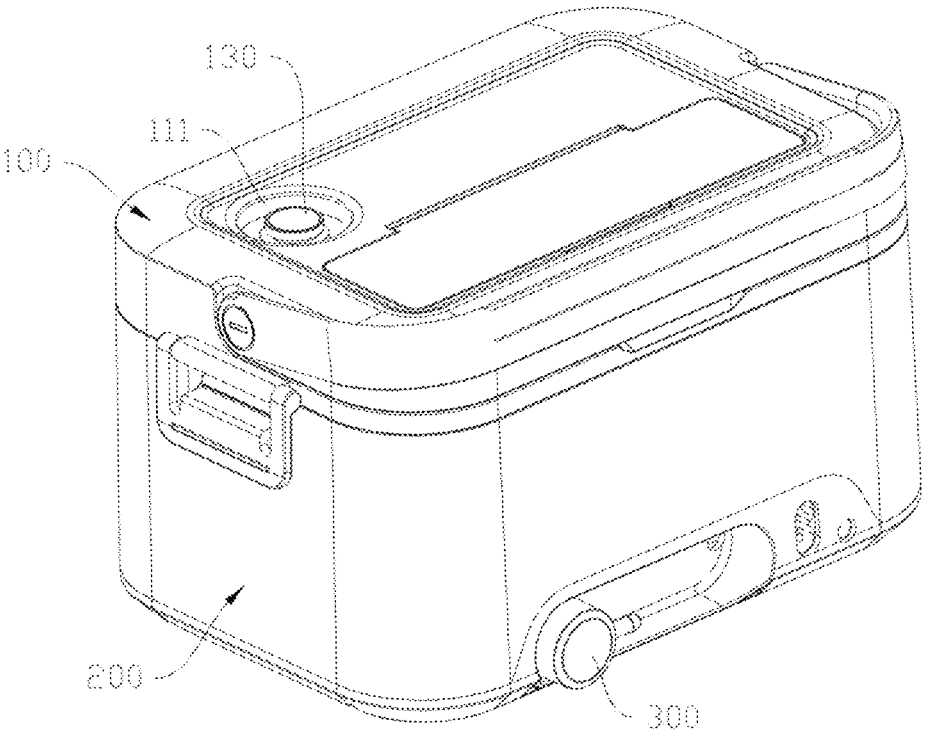
FIG. 6 is a schematic diagram of a heat preservation appliance according to a second embodiment of the present disclosure.

It can be understood that, referring to FIG. 2, an outer side of the box body 200 is provided with an accommodating groove 201, the accommodating groove 201 is matched with the evacuating device 300, and the accommodating groove 201 is used for accommodating the evacuating device 300. The evacuating device 300 is inserted into the accommodating groove 201, which is convenient to carry and does not affect an appearance of the heat preservation appliance. In addition, it can be understood that, referring to FIG. 6, an air evacuating pump in the evacuating device 300 can be accommodated in a housing 200, and the air evacuating pump is connected to the evacuating device through a spring-like flexible air tube, so that a volume of the evacuating device 300 can be reduced, and the evacuating device 300 is compact, exquisite, convenient to carry and beautiful in appearance.

The embodiments of the present disclosure are described in detail with reference to the drawings above, but the present disclosure is not limited to the above embodiments, and various changes may also be made within the knowledge scope of those of ordinary skills in the art without departing from the purpose of the present disclosure.

What is claimed is:

1. A heat preservation appliance, comprising:

a box body provided with a first inner container;

a cover body comprising an inner cover and an outer cover, wherein the inner cover covers the first inner container, the inner cover is provided with a check valve, the outer cover is connected to the box body, the outer cover is provided with an avoidance hole arranged corresponding to the check valve;

an evacuating device connected to the check valve through the avoidance hole, wherein the evacuating device extracts air in the first inner container through the check valve;

wherein the check valve comprises a valve body, the inner cover is provided with an air hole matched with the valve body, an air passage is formed by matching cooperation between the valve body and the air hole, and two ends of the valve body are protruded in a radial direction to form a first sealing part; and wherein an end face at a side of the air hole facing the first inner container protrudes to form a first abutting part, the first abutting part abuts against the first sealing part, the first abutting part is provided with a ventilation groove in the radial direction, and the ventilation groove is communicated with the air hole.

2. The heat preservation appliance according to claim 1, wherein an end face at a side of the air hole facing the outer cover protrudes to form a second abutting part, and the second abutting part abuts against the first sealing part.

3. The heat preservation appliance according to claim 2, wherein the box body is provided with a second inner container, the first inner container is arranged on the second inner container, and both a bottom wall and a side wall of the first inner container abut against the second inner container.

4. The heat preservation appliance according to claim 1, wherein the box body is provided with a second inner container, the first inner container is arranged on the second inner container, and both a bottom wall and a side wall of the first inner container abut against the second inner container.

5. A heat preservation appliance, comprising:

a box body provided with a first inner container;

a cover body comprising an inner cover and an outer cover, wherein the inner cover covers the first inner container, the inner cover is provided with a check valve, the outer cover is connected to the box body, the outer cover is provided with an avoidance hole arranged corresponding to the check valve;

an evacuating device connected to the check valve through the avoidance hole, wherein the evacuating device extracts air in the first inner container through the check valve;

wherein the check valve comprises a valve body, the inner cover is provided with an air hole matched with the valve body, an air passage is formed by matching cooperation between the valve body and the air hole, and two ends of the valve body are protruded in a radial direction to form a first sealing part; and wherein the valve body is provided with a first chamber and a second chamber, the first chamber is arranged at an upper end of the valve body, the first chamber is communicated with outside environment, the second chamber is arranged at a lower end of the valve body, and the second chamber is communicated with the first inner container.

6. The heat preservation appliance according to claim 5, wherein an end face at a side of the air hole facing the outer cover protrudes to form a second abutting part, and the second abutting part abuts against the first sealing part.

7. The heat preservation appliance according to claim 5, wherein the box body is provided with a second inner container, the first inner container is arranged on the second inner container, and both a bottom wall and a side wall of the first inner container abut against the second inner container.

8. A heat preservation appliance, comprising:

a box body provided with a first inner container;

a cover body comprising an inner cover and an outer cover, wherein the inner cover covers the first inner container, the inner cover is provided with a check valve, the outer cover is connected to the box body, the outer cover is provided with an avoidance hole arranged corresponding to the check valve;

an evacuating device connected to the check valve through the avoidance hole, wherein the evacuating device extracts air in the first inner container through the check valve;

wherein an edge of the first inner container protrudes to form a bearing part, the inner cover is provided with a sealing ring, the sealing ring protrudes to form a second sealing part, and the inner cover drives the second sealing part to abut against the bearing part; and wherein a side of the inner cover facing the first inner container protrudes to form a guide part, the sealing ring is arranged between the guide part and a side wall of the first inner container, and the sealing ring respectively abuts against the guide part and the side wall of the first inner container.

9. The heat preservation appliance according to claim 8, wherein the sealing ring protrudes to form a third sealing part, and the third sealing part abuts against the side wall of the first inner container.

10. A heat preservation appliance, comprising:

a box body provided with a first inner container;

a cover body comprising an inner cover and an outer cover, wherein the inner cover covers the first inner container, the inner cover is provided with a check valve, the outer cover is connected to the box body, the outer cover is provided with an avoidance hole arranged corresponding to the check valve;

an evacuating device connected to the check valve through the avoidance hole, wherein the evacuating device extracts air in the first inner container through the check valve; and wherein an outer side of the box body is provided with an accommodating groove matched with the evacuating device, and the accommodating groove is used for accommodating the evacuating device.

11. The heat preservation appliance according to claim 10, wherein the box body is provided with a second inner container, the first inner container is arranged on the second inner container, and both a bottom wall and a side wall of the first inner container abut against the second inner container.

* * * * *